US007732112B2

(12) United States Patent
Wu et al.

(10) Patent No.: US 7,732,112 B2
(45) **Date of Patent: *Jun. 8, 2010**

(54) ELECTROPHOTOGRAPHIC IMAGING MEMBER UNDERCOAT LAYERS

(75) Inventors: Jin Wu, Webster, NY (US); Daniel V. Levy, Rochester, NY (US); Liang-bih Lin, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 398 days.

This patent is subject to a terminal disclaimer.

(21) Appl. No.: 11/481,642

(22) Filed: Jul. 6, 2006

(65) Prior Publication Data

US 2008/0008947 A1 Jan. 10, 2008

(51) Int. Cl.
*G03G 5/047* (2006.01)

(52) U.S. Cl. ..... 430/60; 430/58.8; 430/59.4

(58) Field of Classification Search ..... 430/58.8, 430/69, 59.4, 58.75, 56, 60
See application file for complete search history.

(56) References Cited

U.S. PATENT DOCUMENTS

| | | | | |
|---|---|---|---|---|
| 3,121,006 | A | 2/1964 | Middleton et al. | 430/31 |
| 4,233,384 | A | 11/1980 | Turner et al. | 430/58.75 |
| 4,265,990 | A | 5/1981 | Stolka et al. | 430/58.8 |
| 4,298,697 | A | 11/1981 | Baczek et al. | 521/27 |
| 4,299,897 | A | 11/1981 | Stolka et al. | 430/58.8 |
| 4,306,008 | A | 12/1981 | Pai et al. | 430/58.8 |
| 4,338,390 | A | 7/1982 | Lu | 430/108.2 |
| 4,439,507 | A | 3/1984 | Pan et al. | 430/58.8 |
| 4,464,450 | A | 8/1984 | Teuscher | 430/58.8 |
| 4,560,635 | A | 12/1985 | Hoffend et al. | 430/108.2 |
| 4,921,769 | A | 5/1990 | Yuh et al. | 430/64 |
| 4,921,773 | A | 5/1990 | Melnyk et al. | 430/132 |
| 5,130,216 | A * | 7/1992 | Koyama et al. | 430/58.4 |
| 5,482,811 | A | 1/1996 | Keoshkerian et al. | 430/135 |
| 5,725,985 | A | 3/1998 | Nealey et al. | 430/58.05 |
| 5,958,638 | A | 9/1999 | Katayama et al. | 430/65 |
| 6,017,666 | A | 1/2000 | Nealey et al. | 430/59.4 |
| 6,132,912 | A | 10/2000 | Fuller et al. | 430/58.8 |
| 6,287,737 | B1 | 9/2001 | Ong et al. | 430/58.8 |
| 6,383,699 | B1 * | 5/2002 | Yuh et al. | 430/65 |
| 6,444,386 | B1 | 9/2002 | Liu et al. | 430/64 |
| 7,163,738 | B2 * | 1/2007 | Bermel | 428/339 |
| 7,312,007 | B2 | 12/2007 | Lin et al. | |
| 7,498,109 | B2 | 3/2009 | Wu et al. | |
| 7,544,452 | B2 | 6/2009 | Wu et al. | |
| 2007/0048640 | A1 * | 3/2007 | Wu et al. | 430/60 |

* cited by examiner

*Primary Examiner*—John L Goodrow
(74) *Attorney, Agent, or Firm*—Marylou J. Lavole, Esq. LLC

(57) ABSTRACT

An imaging member includes a substrate; a charge generation layer positioned on the substrate; at least one charge transport layer positioned on the charge generation layer; and an undercoat layer positioned on the substrate on a side opposite the charge generation layer, the undercoat layer comprising a binder component and a metallic component comprising metal thiocyanate and metal oxide.

19 Claims, No Drawings

ELECTROPHOTOGRAPHIC IMAGING MEMBER UNDERCOAT LAYERS

CROSS-REFERENCE TO RELATED APPLICATIONS

Illustrated in U.S. Ser. No. 10/942,277, of Liang-bih Lin et al., filed Sep. 16, 2004, entitled 'Photoconductive Imaging Members,' the disclosure of which is totally incorporated herein by reference, is a photoconductive member containing a hole blocking layer, a photogenerating layer, and a charge transport layer, and wherein the hole blocking layer contains a metallic component like a titanium oxide and a polymeric binder.

Illustrated in U.S. Ser. No. 11/211,757, of Jin Wu et al., filed Aug. 26, 2005, entitled "Thick Electrophotographic Imaging Member Undercoat Layers,' the disclosure of which is totally incorporated herein by reference, are binders containing metal oxide nanoparticles and a co-resin of phenolic resin and aminoplast resin, and electrophotographic imaging member undercoat layer containing the binders.

Illustrated in commonly assigned, co-pending U.S. patent application Ser. No. 11/481,731, U.S. Patent Publication 20080008950 of Jin Wu et al., filed of even date herewith, the disclosure of which is totally incorporated by reference herein, is an imaging member including a substrate; an undercoat layer comprising a binder component, a metallic component, and a thiophosphate additive; a charge generation layer; and a charge transport layer.

BACKGROUND

The present disclosure is generally related to imaging members, also referred to as photoreceptors, photosensitive members, and the like, and in embodiments to undercoat layers containing metal thiocyanate and electrographic imaging members containing the undercoat layers. The imaging members may be used in copy, printer, fax, scan, multifunction machines, and the like. In embodiments, the methods reduce scratching, abrasion, corrosion, fatigue, and cracking, and facilitate cleaning and durability of devices, for example active matrix imaging devices, such as active matrix belts.

The demand for improved print quality in xerographic reproduction is increasing, especially with the advent of color. Common print quality issues are strongly dependent on the quality of the undercoat layer (UCL). Conventional materials used for the undercoat or blocking layer have been problematic. In certain situations, a thicker undercoat is desirable, but the thickness of the material used for the undercoat layer is limited by the inefficient transport of the photo-injected electrons from the charge generating layer to the substrate. If the undercoat layer is too thin, then incomplete coverage of the substrate results due to wetting problems on localized unclean substrate surface areas. The incomplete coverage produces pin holes which can, in turn, produce print defects such as charge deficient spots (CDS) and bias charge roll (BCR) leakage breakdown. Other problems include "ghosting," which is thought to result from the accumulation of charge somewhere in the photoreceptor. Removing trapped electrons and holes residing in the imaging members is desirable to preventing ghosting. During the exposure and development stages of xerographic cycles, the trapped electrons are mainly at or near the interface between charge generating layer (CGL) and undercoating layer (UCL) and holes mainly at or near the interface between charge generating layer and charge transport layer (CTL). The trapped charges can migrate according to the electric field during the transfer stage, where the electrons can move from the interface of CGL/UCL to CTL/CGL or the holes from CTL/CGL to CGL/UCL and became deep traps that are no longer mobile. Consequently, when a sequential image is printed, the accumulated charge results in image density changes in the current printed image that reveals the previously printed image. Thus, there is a need, which the present embodiments address, for a way to minimize or eliminate charge accumulation in photoreceptors, without sacrificing the desired thickness of the undercoat layer.

The terms "charge blocking layer" and "blocking layer" are generally used interchangeably with the phrase "undercoat layer".

In the art of electrophotography, a photoreceptor, imaging member, or the like, comprising a photoconductive insulating layer on a conductive layer is imaged by first uniformly electrostatically charging the surface of the photoconductive insulating layer. The photoreceptor is then exposed to a pattern of activating electromagnetic radiation such as light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

Electrophotographic imaging members or photoreceptors are usually multilayered photoreceptors that comprise a substrate support, an electrically conductive layer, an optional hole blocking layer, an optional adhesive layer, a charge generating layer, and a charge transport layer in either a flexible belt form or a rigid drum configuration. Multilayered flexible photoreceptor members may include an anti-curl layer on the backside of the substrate support, opposite to the side of the electrically active layers, to render the desired photoreceptor flatness.

Examples of photosensitive members having at least two electrically operative layers including a charge generating layer and diamine containing transport layer are disclosed in U.S. Pat. Nos. 4,265,990; 4,233,384; 4,306,008; 4,299,897; and 4,439,507, the disclosures of each of which are hereby incorporated by reference herein in their entireties.

Photoreceptors can also be single layer devices. For example, single layer organic photoreceptors typically comprise a photogenerating pigment, a thermoplastic binder, and hole and electron transport materials.

As more advanced, higher speed electrophotographic copiers, duplicators and printers were developed, the performance requirements for the xerographic components increased. Moreover, complex, highly sophisticated, duplicating and printing systems employing flexible photoreceptor belts, operating at very high speeds, have also placed stringent mechanical requirements and narrow operating limits as well on photoreceptors.

The charge generation layer is capable of photogenerating holes and injecting the photogenerated holes into the charge transport layer. The charge generation layer used in multilayered photoreceptors include, for example, inorganic photoconductive particles or organic photoconductive particles dispersed in a film forming polymeric binder. Inorganic or organic photoconductive material may be formed as a continuous, homogenous charge generation section. Many suitable photogenerating materials known in the art may be used, if desired.

Electrophotographic imaging members or photoreceptors having varying and unique properties are needed to satisfy the vast demands of the xerographic industry. The use of organic photogenerating pigments such as perylenes, bisazos, perinones, and polycyclic quinines in electrophotographic applications is well known. Generally, layered imaging members with the aforementioned pigments exhibit acceptable photosensitivity.

Conventional binders used in electrophotographic imaging members typically contain vinyl chloride. Examples of conventional binders are disclosed in U.S. Pat. No. 5,725,985, incorporated herein by reference in its entirety, and U.S. Pat. No. 6,017,666, incorporated herein by reference in its entirety. Additionally, electrophotographic imaging members may be non-halogenated polymeric binders, such as a non-halogenated copolymers of vinyl acetate and vinyl acid.

Conventional electrophotographic imaging members may have an undercoat layer interposed between the conductive support and the charge generation layer. Examples of conventional undercoat layers are disclosed in U.S. Pat. Nos. 4,265,990; 4,921,769; 5,958,638; 6,132,912; 6,287,737; and 6,444,386; incorporated herein by reference in their entireties.

The appropriate components and processes of the above copending applications may be selected for the present disclosure in embodiments thereof. Further, the appropriate components and process aspects of the each of the foregoing U.S. patents may be selected for the present disclosure in embodiments thereof.

SUMMARY

Embodiments disclosed herein include an imaging member comprising a substrate; a charge generation layer positioned on the substrate; at least one charge transport layer positioned on the charge generation layer; and an undercoat layer positioned on the substrate on a side opposite the charge generation layer, the undercoat layer comprising a binder component and a metallic component comprising metal thiocyanate and metal oxide.

Embodiments disclosed herein further include a process for fabricating an imaging member exhibiting low imaging ghosting.

Embodiments disclosed herein also include an imaging member comprising a substrate; a charge generation layer positioned on the substrate; at least one charge transport layer positioned on the charge generation layer; and an undercoat layer positioned on the substrate on a side opposite the charge generation layer, the undercoat layer comprising a binder component comprising copper (I) thiocyanate and $TiO_2$.

In addition, embodiments disclosed herein include an image forming apparatus for forming images on a recording medium comprising a) a photoreceptor member having a charge retentive surface to receive an electrostatic latent image thereon, wherein said photoreceptor member comprises a metal or metallized substrate, a charge generation layer positioned on the substrate; at least one charge transport layer positioned on the charge generation layer; and an undercoat layer positioned on the substrate on a side opposite the charge generation layer, the undercoat layer comprising a binder component and a metallic component comprising metal thiocyanate and metal oxide; b) a development component to apply a developer material to said charge-retentive surface to develop said electrostatic latent image to form a developed image on said charge-retentive surface; c) a transfer component for transferring said developed image from said charge-retentive surface to another member or a copy substrate; and d) a fusing member to fuse said developed image to said copy substrate.

DETAILED DESCRIPTION

This disclosure is generally directed to imaging members, and more specifically, directed to multilayered photoconductive members with an undercoat layer comprised, for example, of a suitable hole blocking component of, for example, a titanium oxide, a copper (I) thiocyanate, and a binder or polymer. The blocking layer, which can also be referred to as an undercoat layer and possesses conductive characteristics in embodiments, enables, for example, high quality developed images or prints, excellent imaging member lifetimes and thicker layers which permit excellent resistance to charge deficient spots, or undesirable plywooding, and also increases the layer coating robustness, and wherein honing of the supporting substrates may be eliminated thus permitting, for example, the generation of economical imaging members. The undercoat layer is in embodiments in contact with the supporting substrate and is in embodiments situated between the supporting substrate and the photogenerating layer comprised of photogenerating pigments, such as those illustrated in U.S. Pat. No. 5,482,811, the disclosure of which is totally incorporated herein by reference, especially Type V hydroxygallium phthalocyanine.

The imaging members herein in embodiments exhibit ghosting reduction, excellent cyclic/environmental stability, and substantially no adverse changes in their performance over extended time periods since the imaging members comprise a mechanically robust and solvent thick resistant undercoat layer enabling the coating of a subsequent photogenerating layer thereon without structural damage, and which undercoat layer can be easily coated on the supporting substrate by various coating techniques of, for example, dip or slot-coating. The aforementioned photoresponsive, or photoconductive imaging members can be negatively charged when the photogenerating layer is situated between the charge transport layer and the hole blocking layer deposited on the substrate.

Processes of imaging, especially xerographic imaging and printing, including digital, are also encompassed by the present disclosure. More specifically, the layered photoconductive imaging members disclosed herein can in embodiments be selected for a number of different known imaging and printing processes including, for example, electrophotographic imaging processes, especially xerographic imaging and printing processes wherein charged latent images are rendered visible with toner compositions of an appropriate charge polarity. The imaging members as indicated herein are in embodiments sensitive in the wavelength region of, for example, from about 500 to about 900 nanometers, and in particular from about 650 to about 850 nanometers, thus diode lasers can be selected as the light source. Moreover, the imaging members of this invention are useful in color xerographic applications, particularly high-speed color copying and printing processes.

Illustrated herein are in embodiments photoconductive members comprised of a supporting substrate, an undercoat layer thereover, a photogenerating layer, and a charge transport layer, and wherein the undercoat layer is comprised of a metallic component consisting of metal thiocyanate and metal oxide, and a binder component.

In embodiments, the metallic component comprises metal oxide which may be selected from, for example, ZnO, $SnO_2$, $TiO_2$, $Al_2O_3$, $SiO_2$, $ZrO_2$, $In_2O_3$, $MoO_3$, and a complex oxide thereof, and mixtures and combinations thereof. In various embodiments, the metal oxides have a powder volume resistivity varying from about $10^4$ to about $10^{10}$ Ωcm at a 100 kg/cm$^2$ loading pressure, 50% humidity, and room temperature. In various embodiments, the metal oxides are $TiO_2$. In various embodiments, $TiO_2$ can be either surface treated or untreated. Surface treatments include, but are not limited to aluminum laurate, alumina, zirconia, silica, silane, methicone, dimethicone, sodium metaphosphate, and the like and mixtures thereof. Examples of $TiO_2$ include STR-60N (no surface treatment and powder volume resisitivity of approximately $9\times10^5$ Ωcm) (available from Sakai Chemical Industry Co., Ltd.), FTL-100 (no surface treatment and powder volume resisitivity of approximately $3\times10^5$ Ωcm) (available from Ishihara Sangyo Laisha, Ltd.), STR-60 ($Al^2O_3$ coated and powder volume resisitivity of approximately $4\times10^6$ Ωcm) (available from Sakai Chemical Industry Co., Ltd.), TTO-55N (no surface treatment and powder volume resisitivity of approximately $5\times10^5$ Ωcm) (available from Ishihara Sangyo Laisha, Ltd.), TTO-55A ($Al_2O_3$ coated and powder volume resisitivity of approximately $4\times10^7$ Ωcm) (available from Ishihara Sangyo Laisha, Ltd.), MT-150W (sodium metaphosphate coated and powder volume resisitivity of approximately $4\times10^4$ Ωcm) (available from Tayca), and MT-150AW (no surface treatment and powder volume resisitivity of approximately $1\times10^5$ Ωcm) (available from Tayca).

In embodiments, the metallic component comprises metal thiocyanate which may be selected from, for example, copper (I) thiocyanate, barium thiocyanate, calcium thiocyanate, cobalt (II) thiocyanate, lead (II) thiocyanate, lithium thiocyanate, mercury (II) thiocyanate, potassium thiocyanate, silver thiocyanate, sodium thiocyanate, a complex thiocyanate thereof, and mixtures and combinations thereof. In various embodiments, metal thiocyanate and metal oxide of the metallic component can be either surface treated or untreated. Surface treatments include, but are not limited to aluminum laurate, alumina, zirconia, silica, silane, methicone, dimethicone, sodium metaphosphate, and the like and mixtures thereof.

In embodiments, the weight ratio of the metallic component to the binder component can be from about 20/80 to about 80/20, or from about 40/60 to about 70/30. In various embodiments, the weight ratio of metal thiocyanate to metal oxide of the metallic component can be from about 1/99 to about 99/1, or from about 10/90 to about 70/30.

In embodiments, the undercoat layer may also contain a binder component. Examples of the binder component include, but are not limited to, polyamides, vinyl chlorides, vinyl acetates, phenolic resins, polyurethanes, aminoplasts, melamine resins, benzoguanamine resins, polyimides, polyethylenes, polypropylenes, polycarbonates, polystyrenes, acrylics, styrene acrylic copolymers, methacrylics, vinylidene chlorides, polyvinyl acetals, epoxys, silicones, vinyl chloride-vinyl acetate copolymers, polyvinyl alcohols, polyesters, polyvinyl butyrals, nitrocelluloses, ethyl celluloses, caseins, gelatins, polyglutamic acids, starches, starch acetates, amino starches, polyacrylic acids, polyacrylamides, zirconium chelate compounds, titanyl chelate compounds, titanyl alkoxide compounds, organic titanyl compounds, silane coupling agents, and combinations thereof. In embodiments, the binder component comprises a member selected from the group consisting of phenolic-formaldehyde resin, melamine-formaldehyde resin, urea-formaldehyde resin, benzoguanamine-formaldehyde resin, glycoluril-formaldehyde resin, acrylic resin, styrene acrylic copolymer, and mixtures and combinations thereof.

For example, in embodiments, a member includes a supporting substrate, an undercoat layer thereover, a photogenerating layer, and a charge transport layer, and wherein the undercoat layer is comprised of a metallic component consisting of metal thiocyanate and metal oxide and a binder component. In embodiments, a photoconductive member comprised in sequence of an optional supporting substrate, an undercoat layer thereover, a photogenerating layer, and a charge transport layer, and wherein the undercoat layer is comprised of a titanium oxide or a titanium dioxide component, a copper (I) thiocyanate, and a binder component.

Further disclosed herein, in embodiments, is a photoconductive imaging member comprised of a supporting substrate, an undercoat layer thereover, a photogenerating layer and a charge transport layer, and wherein the undercoat layer is comprised of, for example, a mixture of a metal oxide like $TiO_2$, a copper (I) thiocyanate, and a polymer binder, and optionally an electron transport component of, for example, N,N'-bis(1,2-dimethylpropyl)-1,4,5,8-naphthalenetetracarboxylic diimide; N,N'-bis(1,2-dimethylpropyl)-1,4,5,8-naphthalene tetracarboxylic acid; bis(2-heptylimido) perinone; butoxy carbonyl fluorenylidene malononitrile (BCFM); benzophenone bisimide; or a substituted carboxybenzylnaphthaquinone.

In embodiments, the undercoat layer may contain an optional light scattering particle. In various embodiments, the light scattering particle has a refractive index different from the binder and has a number average particle size greater than about 0.8 μm. In various embodiments, the light scattering particle is amorphous silica P-100 commercially available from Espirit Chemical Co. In various embodiments, the light scattering particle is present in an amount of about 0% to about 10% by weight of a total weight of the undercoat layer.

In embodiments, the undercoat layer may contain various colorants. In various embodiments, the undercoat layer may contain organic pigments and organic dyes, including, but not limited to, azo pigments, quinoline pigments, perylene pigments, indigo pigments, thioindigo pigments, bisbenzimidazole pigments, phthalocyanine pigments, quinacridone pigments, quinoline pigments, lake pigments, azo lake pigments, anthraquinone pigments, oxazine pigments, dioxazine pigments, triphenylmethane pigments, azulenium dyes, squalium dyes, pyrylium dyes, triallylmethane dyes, xanthene dyes, thiazine dyes, and cyanine dyes. In various embodiments, the undercoat layer may include inorganic materials, such as amorphous silicon, amorphous selenium, tellurium, a selenium-tellurium alloy, cadmium sulfide, antimony sulfide, titanium oxide, tin oxide, zinc oxide, and zinc sulfide, and combinations thereof.

In embodiments, the thickness of the undercoat layer is from about 0.1 μm to 30 μm, or from about 2 μm to 25 μm, or from about 4 μm to 10 μm. In embodiments, electrophotographic imaging members contain undercoat layer s having a thickness of from about 0.1 μm to 30 μm, or from about 2 μm to 25 μm, or from about 4 μm to 10 μm.

A photoconductive imaging member herein can comprise in embodiments in sequence of a supporting substrate, an undercoat layer, an adhesive layer, a photogenerating layer and a charge transport layer. For example, the adhesive layer can comprise a polyester with, for example, an $M_w$ of about 70,000, and an $M_n$ of about 35,000.

In embodiment, the supporting substrate can be selected from a conductive metal substrate; an aluminum, aluminized polyethylene terephthalate or titanized polyethylene.

In embodiments, the photogenerating layer is selected at a thickness of from about 0.05 to about 12 microns.

In embodiments, the charge transport layer, such as a hole transport layer, is selected at a thickness of from about 10 to about 55 microns.

Photogenerating pigments can be selected for the photogenerating layer in embodiments for example of an amount of from about 10 percent by weight to about 95 percent by weight dispersed in a resinous binder.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), and epoxies, and random or alternating copolymers thereof. In embodiments electrically inactive binders are comprised of polycarbonate resins with for example a molecular weight of from about 20,000 to about 100,000 and more specifically with a molecular weight $M_w$ of from about 50,000 to about 100,000. Examples of polycarbonates are poly(4,4'-isopropylidene-diphenylene)carbonate (also referred to as bisphenol-A-polycarbonate, poly(4,4'-cyclohexylidinediphenylene) carbonate (referred to as bisphenol-Z polycarbonate), poly(4,4'-isopropylidene-3,3'-dimethyldiphenyl)carbonate (also referred to as bisphenol-C-polycarbonate) and the like.

The charge transport layers can comprise in embodiments aryl amine molecules, and other known charge, especially hole transports. For example; a photoconductive imaging member herein wherein the charge transport aryl amines are of the formula

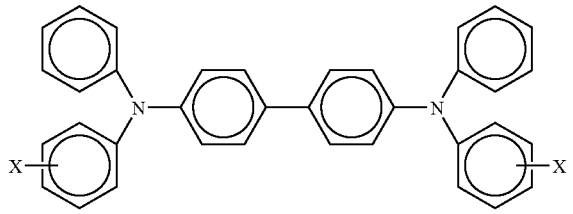

wherein X is alkyl, and wherein the aryl amine is dispersed in a resinous binder; a photoconductive imaging member wherein for the aryl amine alkyl is methyl, wherein halogen is chloride, and wherein the resinous binder is selected from the group consisting of polycarbonates and polystyrene; a photoconductive imaging member wherein the aryl amine is N,N'-diphenyl-N,N-bis(3-methylphenyl)-1,1'-biphenyl-4,4'-diamine.

The charge transport aryl amines can also be of the formula

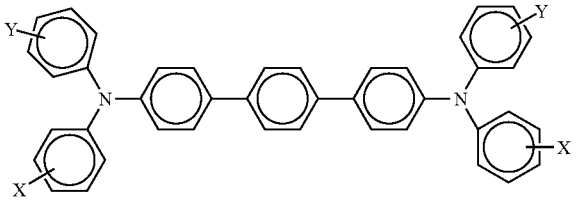

wherein X and Y are independently alkyl, alkoxy, aryl, a halogen, or mixtures thereof. Alkyl and alkoxy can contain for example from 1 to about 25 carbon atoms, and more specifically from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substitutent is a chloro substitutent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine and the like and optionally mixtures thereof. Other known charge transport layer molecules can be selected, reference for example, U.S. Pat. Nos. 4,921,773 and 4,464,450, the disclosures of which are totally incorporated herein by reference. In embodiments, therefore, the charge transport layer comprises aryl amine mixtures.

An adhesive layer may optionally be applied such as to the hole blocking layer. The adhesive layer may comprise any suitable material, for example, any suitable film forming polymer. Typical adhesive layer materials include, but are not limited to, for example, copolyester resins, polyarylates, polyurethanes, blends of resins, and the like. Any suitable solvent may be selected in embodiments to form an adhesive layer coating solution. Typical solvents include, but are not limited to, for example, tetrahydrofuran, toluene, hexane, cyclohexane, cyclohexanone, methylene chloride, 1,1,2-trichloroethane, monochlorobenzene, and mixtures thereof, and the like.

In embodiments, a photoconductive imaging member further includes an adhesive layer of a polyester with an $M_w$ of about 75,000, and an $M_n$ of about 40,000.

The photogenerating layer is comprised in embodiments of metal phthalocyanines, metal free phthalocyanines, perylenes, hydroxygallium phthalocyanines, chlorogallium phthalocyanines, titanyl phthalocyanines, vanadyl phthalocyanines, selenium, selenium alloys, trigonal selenium, and the like, and mixtures and combinations thereof; a photoconductive imaging member wherein the photogenerating layer is comprised of titanyl phthalocyanines, perylenes, or hydroxygallium phthalocyanines; a photoconductive imaging member wherein the photogenerating layer is comprised of Type V hydroxygallium phthalocyanine.

The undercoat layer can in embodiments be prepared by a number of known methods; the process parameters being dependent, for example, on the member desired. The undercoat layer can be coated as solution or a dispersion onto a selective substrate by the use of a spray coater, dip coater, extrusion coater, roller coater, wire-bar coater, slot coater, doctor blade coater, gravure coater, and the like, and dried at from about 40° C. to about 200° C. for a suitable period of time, such as from about 10 minutes to about 10 hours, under stationary conditions or in an air flow. The coating can be accomplished to provide a final coating thickness of in embodiments from about 0.1 to about 30 or about 4 to about 15 micrometers after drying.

Illustrative examples of substrate layers selected for the imaging members of the present invention can be opaque or substantially transparent, and may comprise any suitable material having the requisite mechanical properties. Thus, the substrate may comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as for example a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®. Moreover, the substrate may contain thereover an undercoat layer, including known undercoat layers, such as suitable phenolic resins, phenolic compounds, mixtures of phenolic resins and phenolic compounds, titanium oxide, silicon oxide mixtures like $TiO_2/SiO_2$.

The thickness of the substrate layer depends on many factors, including economical considerations, thus this layer may be of substantial thickness, for example over 3,000 microns, or of minimum thickness providing there are no significant adverse effects on the member. In embodiments, the thickness of this layer is from about 75 microns to about 300 microns.

The photogenerating layer, which can be comprised of the components indicated herein, such as hydroxychlorogallium phthalocyanine, is in embodiments comprised of, for example, about 50 weight percent of the hyroxygallium or other suitable photogenerating pigment, and about 50 weight percent of a resin binder like polystyrene/polyvinylpyridine. The photogenerating layer can contain known photogenerating pigments, such as metal phthalocyanines, metal free phthalocyanines, hydroxygallium phthalocyanines, perylenes, especially bis(benzimidazo)perylene, titanyl phthalocyanines, and the like, and more specifically, vanadyl phthalocyanines, Type V chlorohydroxygallium phthalocyanines, and inorganic components, such as selenium, especially trigonal selenium. The photogenerating pigment can be dispersed in a resin binder similar to the resin binders selected for the charge transport layer, or alternatively no resin binder is needed. Generally, the thickness of the photogenerator layer depends on a number of factors, including the thicknesses of the other layers and the amount of photogenerator material contained in the photogenerating layers. Accordingly, this layer can be of a thickness of, for example, from about 0.05 micron to about 15 microns, or from about 0.25 micron to about 2 microns when, for example, the photogenerator compositions are present in an amount of from about 30 to about 75 percent by volume. The maximum thickness of this layer in embodiments is dependent primarily upon factors, such as photosensitivity, electrical properties and mechanical considerations. The photogenerating layer binder resin present in various suitable amounts, for example from about 1 to about 50 or from about 1 to about 10 weight percent, may be selected from a number of known polymers, such as poly(vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. It is desirable to select a coating solvent that does not substantially disturb or adversely affect the other previously coated layers of the device. Examples of solvents that can be selected for use as coating solvents for the photogenerator layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The coating of the photogenerator layers in embodiments of the present invention can be accomplished with spray, dip or wire-bar methods such that the final dry thickness of the photogenerator layer is, for example, from about 0.01 to about 30 microns or from about 0.1 to about 15 microns after being dried at, for example, about 40° C. to about 150° C. for about 15 to about 90 minutes.

Illustrative examples of polymeric binder materials that can be selected for the photogenerator layer are as indicated herein, and include those polymers as disclosed in U.S. Pat. No. 3,121,006, the disclosure of which is totally incorporated herein by reference; phenolic resins as illustrated in the appropriate copending applications recited herein, the disclosures of which are totally incorporated herein by reference. In general, the effective amount of polymer binder that is utilized in the photogenerator layer ranges from about 0 to about 95 percent by weight, or from about 25 to about 60 percent by weight of the photogenerator layer.

As optional adhesive layers usually in contact with the undercoat layer, there can be selected various known substances inclusive of polyesters, polyamides, poly(vinyl butyral), poly(vinyl alcohol), polyurethane and polyacrylonitrile. This layer is, for example, of a thickness of from about 0.001 micron to about 3 microns or about 1 micron. Optionally, this layer may contain effective suitable amounts, for example from about 1 to about 10 weight percent, conductive and nonconductive particles, such as zinc oxide, titanium dioxide, silicon nitride, carbon black, and the like, to provide, for example, in embodiments of the present invention further desirable electrical and optical properties.

Various suitable known charge transport compounds, molecules and the like can be selected for the charge transport layer, such as aryl amines of the following formula

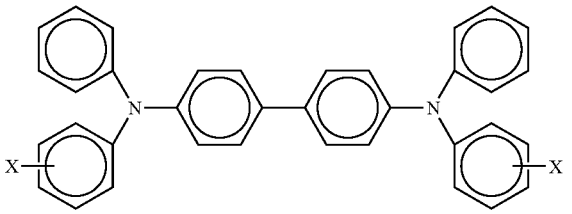

wherein a thickness thereof is, for example, from about 5 microns to about 75 microns or from about 10 microns to about 40 microns dispersed in a polymer binder, wherein X is selected from the group consisting of alkyl, alkoxy, aryl and halogen, and the alkyl contains for example from about 1 to about 10 carbon atoms, or mixtures thereof, for example, in embodiments, substitutents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substitutent is preferably a chloro substitutent. Other known charge transport layer molecules can be selected, reference for example U.S. Pat. Nos. 4,921,773 and 4,464,450, the disclosures of which are totally incorporated herein by reference.

The charge transport aryl amines can also be of the formula

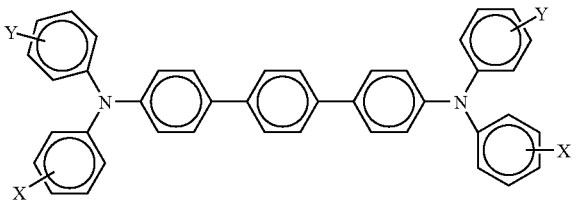

wherein X and Y are independently alkyl, alkoxy, aryl, a halogen, or mixtures thereof. Alkyl and alkoxy contain for example from 1 to about 25 carbon atoms, and more specifically from 1 to about 10 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide and fluoride. Substituted alkyls, alkoxys, and aryls can also be selected in embodiments.

Examples of specific aryl amines include N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine and the like.

In embodiments, the at least one charge transport layer comprises an antioxidant optionally comprised of, for example, a hindered phenol or a hindered amine.

Examples of binder materials for the transport layers include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies, and block, random or alternating copolymers thereof. In embodiments, electrically inactive binders are selected comprised of polycarbonate resins having a molecular weight of from about 20,000 to about 100,000 or from about 50,000 to about 100,000. Generally, the transport layer contains from about 10 to about 75 percent by weight of the charge transport material or from about 35 percent to about 50 percent of this material.

In embodiments, the at least one charge transport layer comprises from about 1 to about 7 layers. For example, in embodiments, the at least one charge transport layer comprises a top charge transport layer and a bottom charge transport layer, wherein the bottom layer is situated between the charge generation layer and the top layer.

Also, included herein are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

Various exemplary embodiments encompassed herein include a method of imaging which includes generating an electrostatic latent image on an imaging member, developing a latent image, and transferring the developed electrostatic image to a suitable substrate.

Various exemplary embodiments include methods including forming an electrostatic latent image on an imaging member; developing the image with a toner composition including, for example, at least one thermoplastic resin, at least one colorant, such as pigment, at least one charge additive, and at least one surface additive; transferring the image to a necessary member, such as, for example any suitable substrate, such as, for example, paper; and permanently affixing the image thereto. In various exemplary embodiments in which the embodiment is used in a printing mode, various exemplary imaging methods include forming an electrostatic latent image on an imaging member by use of a laser device or image bar; developing the image with a toner composition including, for example, at least one thermoplastic resin, at least one colorant, such as pigment, at least one charge additive, and at least one surface additive; transferring the image to a necessary member, such as, for example any suitable substrate, such as, for example, paper; and permanently affixing the image thereto.

In a selected embodiment, an image forming apparatus for forming images on a recording medium comprises a) a photoreceptor member having a charge retentive surface to receive an electrostatic latent image thereon, wherein said photoreceptor member comprises a metal or metallized substrate, an undercoat layer comprising a binder component, a metallic component consisting of metal thiocyanate and metal oxide; a charge generating layer comprising photoconductive pigment, and a charge transport layer comprising charge transport materials dispersed therein; b) a development component to apply a developer material to said charge-retentive surface to develop said electrostatic latent image to form a developed image on said charge-retentive surface; c) a transfer component for transferring said developed image from said charge-retentive surface to another member or a copy substrate; and d) a fusing member to fuse said developed image to said copy substrate.

EXAMPLES

The following Examples are being submitted to further define various species of the present disclosure. These Examples are intended to be illustrative only and are not intended to limit the scope of the present disclosure. Also, parts and percentages are by weight unless otherwise indicated.

Illustrative photoresponsive imaging members were fabricated as follows. Multilayered photoreceptors of the rigid drum design were fabricated by conventional coating technology with an aluminum drum of 34 millimeters in diameter as the substrate. All the photoreceptors contained the same charge generating layer and charge transport layer. The difference is that Comparative Example 1 contained an undercoat layer (UCL) comprising a phenolic resin, a melamine resin, titanium oxide; Example 1 contained the same layers as Comparative Example 1 except that copper (I) thiocyanate was incorporated into the UCL; Example 2 contained an undercoat layer (UCL) comprising a phenolic resin, titanium oxide and lithium thiocyanate; Example 3 contained an undercoat layer (UCL) comprising a melanine resin, a styrene acrylic copolymer, titanium oxide and lead (II) thiocyanate.

Comparative Example 1

The undercoat layer was prepared as follows: a titanium oxide/phenolic resin/melamine resin dispersion was prepared by ball milling 15 grams of titanium dioxide (MT-150W, Tayca Company), 3 grams of the phenolic resin (VARCUM™ 29159, OxyChem Company, $M_w$ of about 3,600, viscosity of about 200 cps) and 7 grams of the melamine resin (CYMEL™ 323, CYTEC) in 7.5 grams of 1-butanol, and 7.5 grams of xylene with 120 grams of 1 millimeter diameter sized $ZrO_2$ beads for 5 days. The resulting titanium dioxide dispersion was filtered with a 20 micrometer pore size nylon cloth, and then the filtrate was measured with Horiba Capa 700 Particle Size Analyzer, and there was obtained a median $TiO_2$ particle size of 50 nanometers in diameter and a $TiO_2$ particle surface area of 30 $m^2$/gram with reference to the above $TiO_2$NVARCUM™/CYMEL™ dispersion. Then an aluminum drum, cleaned with detergent and rinsed with deionized water, was coated with the above generated coating dispersion, and subsequently, dried at 150° C. for 40 minutes, which resulted in an undercoat layer deposited on the aluminum and comprised of $TiO_2$NVARCUM™/CYMEL™ with a weight ratio of about 60/12/28 and a thickness of 4 μm.

The charge generating layer was prepared as follows: 2.7 grams of Type B chlorogallium phthalocyanine (ClGaPc) pigment was mixed with about 2.3 grams of polymeric binder VMCH (Dow Chemical), 30 grams of xylene and 15 grams of n-butyl acetate. The mixture was milled in an ATTRITOR mill with about 200 grams of 1 mm Hi-Bea borosilicate glass beads for about 3 hours. The dispersion was filtered through a 20-μm nylon cloth filter, and the solid content of the dispersion was diluted to about 5.8 weight percent with a mixture of xylene/n-butyl acetate=2/1 (weight/weight). The ClGaPc charge generating layer dispersion was applied on top of the above undercoat layer. The thickness of the charge generating layer was approximately 0.2 μm.

Subsequently, a 30-μm charge transport layer was coated on top of the charge generating layer, respectively, which coating dispersion was prepared as follows: N,N'-diphenyl-N,N-bis(3-methylphenyl)-1,1'-biphenyl-4,4'-diamine (5.38 grams), a film forming polymer binder PCZ 400 [poly(4,4'-dihydroxy-diphenyl-1-1-cyclohexane, $M_w$=40,000)] available from Mitsubishi Gas Chemical Company, Ltd. (7.13 grams), and PTFE POLYFLON L-2 microparticle (1 gram) available from Daikin Industries were dissolved/dispersed in a solvent mixture of 20 grams of tetrahydrofuran (THF) and 6.7 grams of toluene via CAVIPRO 300 nanomizer (Five Star technology, Cleveland, Ohio). The charge transport layer was dried at about 120° C. for about 40 minutes.

Example 1

The undercoat layer was prepared as follows: a copper (I) thiocyanate (CuSCN)/titanium oxide/phenolic resin/melamine resin dispersion was prepared by ball milling 1.25 grams of copper (I) thiocyanate, 15 grams of titanium dioxide (MT-150W, Tayca Company), 3 grams of the phenolic resin (VARCUM™ 29159, OxyChem Company, $M_w$ of about 3,600, viscosity of about 200 cps) and 7 grams of the melamine resin (CYMEL™ 323, CYTEC) in 7.5 grams of 1-butanol, and 7.5 grams of xylene with 120 grams of 1 millimeter diameter sized $ZrO_2$ beads for 5 days. The resulting copper (I) thiocyanate/titanium dioxide dispersion was filtered with a 20 micrometer pore size nylon cloth. Then an aluminum drum, cleaned with detergent and rinsed with deionized water, was coated with the above generated coating dispersion, and subsequently, dried at 150° C. for 40 minutes, which resulted in an undercoat layer deposited on the aluminum and comprised of CuSCN/$TiO_2$/VARCUM™/CYMEL™ with a weight ratio of about 5/60/12/28 and a thickness of 4 μm.

Example 2

The undercoat layer is prepared as follows: a lithium thiocyanate (LiSCN)/titanium oxide/phenolic resin dispersion is prepared by ball milling 5 grams of LiSCN, 10 grams of titanium dioxide (MT-150W, Tayca Company), and 10 grams of the phenolic resin (VARCUM™ 29159, OxyChem Company, $M_w$ of about 3,600, viscosity of about 200 cps) in 7.5 grams of 1-butanol, and 7.5 grams of xylene with 120 grams of 1 millimeter diameter sized $ZrO_2$ beads for 5 days. The resulting lithium thiocyanate/titanium dioxide dispersion is filtered with a 20 micrometer pore size nylon cloth. Then an aluminum drum, cleaned with detergent and rinsed with deionized water, is coated with the above generated coating dispersion, and subsequently, dried at 160° C. for 15 minutes, which results in an undercoat layer deposited on the aluminum and comprised of LiSCN/$TiO_2$/VARCUM™°with a weight ratio of about 20/40/40 and a thickness of 10 μm.

Example 3

The undercoat layer dispersion was prepared as follows: in a 120 ml glass bottle, 13 grams of lead (II) thiocyanate, 0.5 grams of $TiO_2$ MT-150W (available from Tayca Co.), 4.5 grams of JONCRYL 580 (available from Johnson Polymers LLC), 4.5 grams of CYMEL 323 (80 wt % in isopropanol) (available from Cytec Industries Inc.) and 30 grams of MEK were mixed with 150 grams of 2 mm $ZrO_2$ beads. The ball milling was carried out for 30 hours under 200 rpm. The dispersion was filtered through a 20 μm Nylon cloth filter, and the final dispersion was measured for $S_w$~15 $m^2$/g with Horiba Capa 700 Particle Size Analyzer. Then an aluminum drum, cleaned with detergent and rinsed with deionized water, is coated with the above generated coating dispersion, and subsequently, dried at 160° C. for 40 minutes, which results in an undercoat layer deposited on the aluminum and comprised of LiSCN/$TiO_2$/JONCRYL/CYMEL with a weight ratio of about 57/3/20/20 and a thickness of 15 μm.

The first two photoreceptor devices were tested in a scanner set to obtain photo-induced discharge cycles, sequenced at one charge-erase cycle followed by one charge-expose-erase cycle, wherein the light intensity was incrementally increased with cycling to produce a series of photo-induced discharge characteristic curves from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The devices were tested at surface potentials of 700 volts with the exposure light intensity incrementally increased by means of regulating a series of neutral density filters; the exposure light source was a 780-nanometer light emitting diode. The aluminum drum was rotated at a speed of 55 revolutions per minute to produce a surface speed of 277 millimeters per second or a cycle time of 1.09 seconds. The xerographic simulation was completed in an environmentally controlled light tight chamber at ambient conditions (40 percent relative humidity and 22° C.). Two photo-induced discharge characteristic (PIDC) curves were generated. The PIDC results are summarized in Table 1. Incorporation of CuSCN into undercoat layer increased ClGaPc photosensitivity (initial slope of the PIDC) by about 10%, and decreased V(2.8 ergs/cm$^2$), which represents the surface potential of the device when exposure is 2.8 ergs/cm$^2$, about 50V.

The two devices were acclimated for 24 hours before testing in J zone (70° F. and 10% humidity) for ghosting test. Print test was done in Copeland Work centre Pro 3545 using K station at t=500 print counts. Run-up from t=0 to t=500 print counts for the device was done in one of the CYM color stations. Ghosting levels were measured against TSIDU SIR scale (from Grade 1 to Grade 6). The smaller the ghosting grade (absolute value), the better the print quality. The ghosting results are also summarized in Table 1, and negative ghosting grades indicate negative ghosting. Incorporation of CuSCN into undercoat layer reduced ghosting by about two grades.

TABLE 1

| | Sensitivity (Vcm$^2$/erg) | V (2.8 ergs/cm$^2$) (V) | J zone ghosting (t = 500 prints) |
|---|---|---|---|
| Comparative Example 1 | −207 | 276 | −5 |
| Example 1 | −223 | 221 | −3 |

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

The invention claimed is:

1. An imaging member comprising:

a substrate;

a charge generation layer positioned on the substrate;

at least one charge transport layer positioned on the charge generation layer; and an undercoat layer positioned on the substrate on a side opposite the charge generation layer, the undercoat layer comprising a binder component and a metallic component comprising metal thiocyanate and metal oxide;

wherein the weight ratio of the metallic component to the binder component is from about 20/80 to about 80/20.

2. The imaging member of claim 1, wherein the binder component comprises a member selected from the group consisting of phenolic-formaldehyde resin, melamine-formaldehyde resin, urea-formaldehyde resin, benzoguanamine-formaldehyde resin, glycoluril-formaldehyde resin, acrylic resin, styrene acrylic copolymer and mixtures and combinations thereof.

3. The imaging member of claim 1, wherein the metal thiocyanate of the metallic component comprises a member selected from the group consisting of copper (I) thiocyanate, barium thiocyanate, calcium thiocyanate, cobalt (II) thiocyanate, lead (II) thiocyanate, lithium thiocyanate, mercury (II) thiocyanate, potassium thiocyanate, silver thiocyanate, sodium thiocyanate and mixtures and combinations thereof; and wherein the metal oxide of the metallic component comprises a member selected from the group consisting of ZnO, $SnO_2$, $TiO_2$, $Al_2O_3$, $SiO_2$, $ZrO_2$, $In_2O_3$, $MoO_3$ and mixtures and combinations thereof.

4. The imaging member of claim 1, wherein the metal thiocyanate and metal oxide of the metallic component is surface treated with a member selected from the group consisting of aluminum laurate, alumina, zirconia, silica, silane, methicone, dimethicone, sodium metaphosphate, and mixtures and combinations thereof.

5. The imaging member of claim 1, wherein the undercoat layer is of a thickness of from about 0.1 micrometer to about 30 micrometers.

6. The imaging member of claim 1, wherein the undercoat layer is of a thickness of from about 4 micrometer to about 10 micrometers.

7. The imaging member of claim 1, wherein the weight ratio of the metal thiocyanate to the metal oxide of the metallic component is from about 1/99 to about 99/1.

8. The imaging member of claim 1, wherein the weight ratio of the metal thiocyanate to the metal oxide of the metallic component is from about 10/90 to about 70/30.

9. The imaging member of claim 1, wherein the charge generation layer comprises a member selected from the group consisting of vanadyl phthalocyanine, metal phthalocyanines, metal-free phthalocyanine, hydroxygallium phthalocyanine, titanyl phthalocyanine, chlorogallium phthalocyanine, and mixtures and combinations thereof.

10. The imaging member of claim 1 wherein the charge transport layer is comprised of aryl amine molecules, and which aryl amines are of the formula

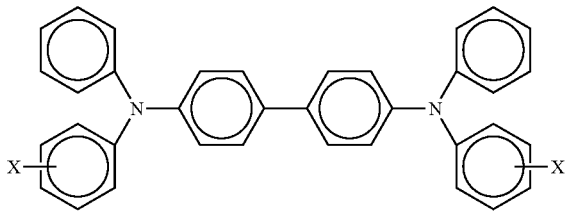

wherein X is selected from the group consisting of alkyl, alkoxy, aryl and halogen, and said alkyl contains from about 1 to about 10 carbon atoms.

11. The imaging member of claim 1 wherein the charge transport layer is comprised of aryl amine molecules, and which aryl amines are of the formula

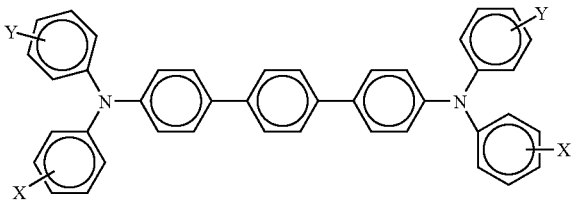

wherein each X and Y is independently selected from the group consisting of alkyl, alkoxy, aryl and halogen.

12. The imaging member in accordance with claim 11 wherein each alkoxy and alkyl contains from about 1 to about 10 carbon atoms; aryl contains from 6 to about 36 carbon atoms; and halogen is chloride, bromide, fluoride, or iodide.

13. The imaging member in accordance with claim 12 wherein said aryl amine is selected from the group consisting of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, and optionally mixtures thereof.

14. The imaging member in accordance with claim 1 wherein the charge transport layer is comprised of aryl amine mixtures.

15. The imaging member of claim 1 wherein the at least one charge transport layer contains an antioxidant optionally comprised of a hindered phenol or a hindered amine.

16. The imaging member of claim 1 wherein the at least one charge transport layer is from 1 to about 7 layers.

17. The imaging member of claim 1 wherein the at least one charge transport layer is comprised of a top charge transport layer and a bottom charge transport layer and wherein the bottom layer is situated between the charge generation layer and the top layer.

18. An imaging member comprising:

a substrate;

a charge generation layer positioned on the substrate;

at least one charge transport layer positioned on the charge generation layer; and an undercoat layer positioned on the substrate on a side opposite the charge generation layer, the undercoat layer comprising a binder component and a metallic component comprising copper (I) thiocyanate and $TiO_2$;

wherein the weight ratio of the metallic component to the binder component is from about 20/80 to about 80/20.

19. An image forming apparatus for forming images on a recording medium comprising:

a) a photoreceptor member having a charge retentive surface to receive an electrostatic latent image thereon, wherein said photoreceptor member comprises a metal or metallized substrate, a charge generation layer positioned on the substrate; at least one charge transport layer positioned on the charge generation layer; and an undercoat layer positioned on the substrate on a side opposite the charge generation layer, the undercoat layer comprising a binder component and a metallic component comprising metal thiocyanate and metal oxide wherein the weight ratio of the metallic component to the binder component is from about 20/80 to about 80/20;

b) a development component to apply a developer material to said charge-retentive surface to develop said electrostatic latent image to form a developed image on said charge-retentive surface;

c) a transfer component for transferring said developed image from said charge-retentive surface to another member or a copy substrate; and d) a fusing member to fuse said developed image to said copy substrate.

* * * * *